US006528111B1

(12) United States Patent
Taniwaki et al.

(10) Patent No.: US 6,528,111 B1
(45) Date of Patent: Mar. 4, 2003

(54) TILED ROAD SURFACE

(75) Inventors: Hajime Taniwaki, Tokyo (JP); Osamu Taitoh, Tokyo (JP); Yoshishige Takagi, Chiba (JP)

(73) Assignee: Nippon Hodo Co., Ltd., Tokyo (JP)

( * ) Notice: Subject to any disclaimer, the term of this patent is extended or adjusted under 35 U.S.C. 154(b) by 0 days.

(21) Appl. No.: 09/543,296

(22) Filed: Apr. 5, 2000

(30) Foreign Application Priority Data

Apr. 7, 1999 (JP) ..... 11-100064
Jun. 11, 1999 (JP) ..... 11-004190
Jun. 11, 1999 (JP) ..... 11-004191

(51) Int. Cl.[7] ..... B05D 5/00; B05D 5/02

(52) U.S. Cl. ..... 427/136; 427/140; 427/307; 427/309; 134/3; 216/103

(58) Field of Search ..... 427/307, 309, 427/136, 140; 15/104.93; 401/23; 68/62; 118/264, 266; 134/3; 216/103

(56) References Cited

U.S. PATENT DOCUMENTS 4,537,796 A * 8/1985 Buys et al. ..... 427/136
4,560,606 A * 12/1985 Rapp et al. ..... 428/141
4,607,508 A * 8/1986 Sando et al. ..... 68/22
5,223,168 A * 6/1993 Holt ..... 252/142

FOREIGN PATENT DOCUMENTS

JP 10179498 A * 7/1998

* cited by examiner

*Primary Examiner*—Michael Barr
*Assistant Examiner*—Elena Tsoy
(74) *Attorney, Agent, or Firm*—Dilworth & Barrese LLP

(57) ABSTRACT

Provided is a method for recovering a slip resistance value of a basalt-tiled road surface by treating with an acid solution.

10 Claims, 4 Drawing Sheets

TILED ROAD SURFACE

FIELD OF THE INVENTION

The present invention relates to an improvement of a tiled road surface suitable for use in an automobile test course or the like.

BACKGROUND OF THE INVENTION

For constructing a low mu ($\mu$) road surface for an automobile test course or the like there sometimes is used a precast concrete slab with tiles such as basalt tiles affixed to the surface thereof.

Basalt tile is fabricated by placing molten basalt into a mold and subsequent molding and surface roughening to a desired roughness. The basalt tile surface has a fine roughness and permits a stable formation of a thin water film thereon by sprinkling water thereto. A road surface having a thin water film formed thereon deteriorates the grip force of tire to a remarkable extent and therefore a road surface faced with basalt tiles is effective as a low $\mu$ road such as a test course or a snow-covered road experience course.

However, the basalt-tiled road surface is lost its fine surface roughness due to wear thereof caused by contact of a test tire therewith or due to years of exposure to the weather. Consequently, it becomes difficult to obtain a slip resistance value necessary for the test and it is no longer possible to achieve the object of the test. The required resistance value can be recovered by imparting a fine roughness again to the tile surface. Heretofore, the tile surface has been roughened using a grindstone. This conventional method, however, requires skill for the roughening work because the roughening must be done uniformly. Besides, a lot of time is needed for carrying out the work, thus giving rise to the problem that the test cannot be conducted over a long period of time.

In case of using basalt tiles in the form of a precast slab, various problems are encountered at present in the process of its fabrication and in the quality of the resulting product.

OBJECTS OF THE INVENTION

It is an object of the present invention to provide a method for recovering a slip resistance value of a basalt-tiled road surface to a desired value in a simple manner and in a short period, as well as an equipment suitable for used in the said method.

It is another object of the present invention to provide a basalt tile for affording such a low $\mu$ road precast slab as affords a uniform frictional resistance and can be fabricated easily.

It is a further object of the present invention to provide a precast slab for an automobile test course which precast slab is superior in working efficiency and can afford a road surface of a desired quality.

SUMMARY OF THE INVENTION

The present invention, in the first aspect thereof, resides in a method for recovering a slip resistance value of a basalt-tiled road surface, characterized by treating the basalt-tiled road surface with an acid solution.

The present invention, in the second aspect thereof, resides in the above method wherein the treatment with the acid solution comprises the steps of applying the acid solution to the road surface for forming a layer of the acid solution on the road surface, allowing the basalt tile to react with the acid solution to roughen the road surface while suppressing the evaporation of the applied acid solution, and removing the treating means including the acid solution.

The present invention, in the third aspect thereof, resides in a road surface treating equipment constituted by a combination of a mat laying apparatus and a mat winding apparatus, the mat laying apparatus having an elongated mat for the impregnation of a treating solution therein and a treating solution tank, the elongated mat having on one side thereof an air-tight film for preventing the evaporation of the treating solution.

The present invention, in the fourth aspect thereof, resides in a special shape basalt tile for a low mu ($\mu$) road precast slab, characterized by having a rectangular shape of about 200 mm long by about 150 mm or about 250 mm wide.

The present invention, in the fifth aspect thereof, resides in the above special shape basalt tile, which is disposed at an end of every other row of square basalt tiles each about 200 mm in both length and width, the basalt tiles being affixed to the surface of a precast concrete slab so that adjacent rows of the basalt tiles are displaced about 50 mm from each other.

The present invention, in the sixth aspect thereof, resides in a precast concrete slab for an automobile test course with tiles affixed to the surface thereof which tiles are typified by basalt tiles, characterized in that a tile is present also in a surface portion of the precast concrete slab where a hoisting, height adjusting and back-filling hole is formed, the tile present in the said surface portion also having a hole in communication with the hole formed in the precast concrete slab.

PREFERRED EMBODIMENTS OF THE INVENTION

Reference will first be made below to a mode of treating a basalt-tiled road surface with an acid solution.

The acid solution used in the present invention is essentially not limited if only it is an acid liquid, but one having a pH value of 3.5 to 5.5 is particularly preferred. As an acid substance which forms the acid solution there may be used any of the following substances usually in the state of an aqueous solution and after an appropriate pH adjustment: general organic and inorganic acids such as sulfuric acid, sulfurous acid, hydrochloric acid, hydrofluoric acid, hydrobromic acid, hydriodic acid, phosphoric acid, nitric acid, chlorosulfonic acid, perchloric acid, nitrous acid, hypochlorous acid, selenic acid, arsenic acid, cyanic acid, boric acid, formic acid, acetic acid, oxalic acid, citric acid, lactic acid, tartaric acid, benzoic acid, salicylic acid, benzenesulfonic acid, gallic acid, phthalic acid, monochloroacetic acid, butyric acid, and picric acid, as well as chromic acid, iodine water, bromine water, fluorine water, hydrogen fluoride water, chlorine solution, chlorine dioxide solution, aldehydes, benzyl chloride, benzoyl chloride, chloroform, methyl chloride, methylene chloride, diethylene dichloride, ethylene chloride, ethyl chloride, chlorobenzene, and dichlorobenzene.

If an acid solution is worked on the surface of a basalt tile which has become smooth after repeated use, the tile surface will be eroded not uniformly but unevenly. Particularly, if a weakly acid solution with a pH value of 3.5 to 5.5 is worked on the basalt tile surface for 15 minutes to 24 hours, the tile surface will have a roughness suitable for a low $\mu$ road surface. A basalt-tiled road surface is laid mainly outdoors, but by keeping the basalt tile surface in contact with an acid solution while preventing the evaporation of the acid solution, it becomes possible to roughen the tile surface to a desired extent, whereby the original resistance value of the basalt-tiled road surface is recovered.

The application of an acid solution to the basalt tile surface may be done using a brush or by spraying from a nozzle, but an acid-resistant mat (sheet) impregnated with the acid solution may be affixed onto the tile surface. As examples of such a mat there are mentioned fabrics and non-woven fabrics prepared using natural or synthetic fibers, sheet-like materials with porous substances such as sponge and zeolite incorporated therein, and papers, including Japanese hand-made paper. Particular effective is a paper mat.

Any of the mats just exemplified above, which is impregnated with an acid solution, is laid on a basalt-tiled road surface and the evaporation of the acid solution is prevented (for moisture retention). By so doing, not only the amount of the acid solution used can be decreased, but also a sufficient working time of the acid solution can be ensured. As a method for moisture retention there is a method wherein a basalt-tiled road surface applied with an acid solution is covered with a less air-permeable sheet made of a synthetic resin or the like to suppress the evaporation of the solution.

In the case where the application of an acid solution is performed by laying a mat such as a paper mat impregnated with the acid solution onto a road surface, a coating material which is not water-soluble and which can ensure air-tightness, e.g., wax, silicone, polyvinyl chloride, polyurethane, acrylic resin, polyethylene, polyester, or asphalt, may be applied to the surface of the mat after the mat has been laid on the road surface. Most preferably, an air-tight synthetic resin film such as polyvinyl chloride film or polyethylene film is affixed or applied to one side of an impregnatable mat such as a paper mat.

A portion or the whole of a basalt-tiled road surface may be covered with a tent beforehand and an acid solution may be sprinkled under the tent. For roughening the basalt tile surface to an extremely fine extent, not only the suppression of evaporation but also the control of the reaction temperature of acid is important. It is preferable to keep the inside of the tent at a constant temperature with use an air conditioner or the like.

The roughening process involves reacting a basalt tile and an acid solution until the surface of the tile reaches a desired roughness. If the reaction time is known in advance, the duration of this process is set using a watch, while if such is not the case, a slip resistance (BPN) may be measured suitably to determine the termination of this process.

When the surface condition of the basalt tile has reached the desired roughness with the reaction thereof with the acid solution, the acid solution and the cover means are removed. If the means for suppressing the evaporation of the acid solution is sheet, the acid solution is removed after or simultaneously with removable of the sheet. If the acid solution evaporation suppressing means is tent, the acid solution is first removed. For removing the acid solution there may be adopted, for example, a suction method, a wipe-off method, or a neutralizer sprinkling method.

In the case where a mat having on one side thereof an air-tight film for the suppression of evaporation is used, the wipe-off work is lightened. In case of using a neutralizer, there is formed a salt such as sodium chloride and it is usually required to remove the salt by suction. Generally, it is difficult to remove an acid solution or a neutralizing solution completely, so it is preferable to wash the basalt tile surface with water.

FIG. 1 shows an example of the above method, in which a road surface treating equipment is made up of a mat laying apparatus 1 and a mat winding apparatus 2. A treating solution tank 3 is mounted on the mat laying apparatus 1. A treating solution (acid solution) 4, which has been pH-adjusted, is contained in the tank 3 (the acid solution will hereinafter be referred to merely as "solution"). The treating solution tank 3 is lined with an acid-resistant material. A take-up roller 5 is provided in the tank 3 and an elongated mat 6 to be impregnated with the acid solution is wound round the take-up roller 5, the mat 6 comprising a paper mat and a filmy vinyl chloride resin coated thereon. The elongated mat 6 leaves the take-up roller 5, then passes below tension rollers 7 and 8, then passes squeeze rollers 9 which are disposed on top of the treating solution tank 3 so as to face the tank and which can be adjusted their squeeze pressure, further passes tension rollers 10 and 11, and reaches a pressing roller 12 located at a rear position of the mat laying apparatus 1. The mat 6 absorbs the solution while diving into the treating solution 4 in the tank 3 and is adjusted to a desired water retention by the squeeze rollers 9. As the mat laying apparatus 1 is moved forward, the mat 6 is laid on a basalt-tiled road surface 13.

The mat winding apparatus 2 is constructed by mounting the components of the mat laying apparatus in a substantially opposite manner. That is, successively from the front to the rear side there are disposed a pressing roller 14, a tension roller 15, squeeze rollers 16, and a take-up roller 17. Below the squeeze rollers 16 is mounted a solution recovery tank 18 for recovering the solution which is squeezed out from the elongated mat 6 by the squeeze rollers 16. In the mat winding apparatus 2 it is not necessary to let the elongated mat 6 to dive into the treating solution tank 3 although it is necessary to do so in the mat laying apparatus 1, so the mat 6 is taken up onto the take-up roller 17 just after leaving the squeeze rollers 16.

There is adopted the following working method. The elongated mat 6, which is in a rolled state, is loaded onto the take-up roller 5 in the mat laying apparatus 1 and is drawn out up to the pressing roller 12 as in FIG. 1. Then, the mat laying apparatus 1 is moved forward to lay the mat 6 while allowing the mat to be impregnated with the treating solution 4. Under a strong wind it is necessary to put weights on the thus-laid elongated mat 6 so as to prevent the mat from being blown up. Usually, however, it is not necessary to use such weights because the mat 6 is impregnated with the treating solution 4 and is therefore heavy. After the laid mat 6 has been allowed to stand for a predetermined period of time, it is taken up again in a rolled state by the mat winding apparatus 2. The mat 6 thus taken up is removed from the take-up roller and is again loaded to the mat laying apparatus 1.

A comparison was made between the work execution capacity obtained in the use of a conventional grinding machine and that obtained in the above method according to the present invention. As a conventional roughening machine there was used a grind-off machine (carrying four rotary grinding wheels, execution width 1,000, diameter 30 cm, using second-cut grindstones). As to the present invention, the equipment described above was used. The mat laying time was set at 45 minutes. For obtaining the same slip resistance, the work execution capacity according to the conventional method was 50 $m^2/h$, while that according to the method of the invention was 80 $m^2/h$, provided the number of workers was the same.

By the above method of the present invention it is possible to restore a basalt-tiled road surface to its original state free of uneveness and having a uniform slip resistance. Besides, the required work is simple and does not require any skill, whereby the work period can be shortened and it is possible to facilitate the maintenance and management of the basalt-tiled road surface and reduce the maintenance cost.

The road surface treating equipment comprising the mat laying apparatus and the mat winding apparatus described above, which is suitable for the treatment of a basalt-tiled road surface with an acid solution, is also applicable to the treatment of other road surfaces with other treating solutions.

It turned out that a special shape basalt tile precast slab having a rectangular shape of about 200 mm long by about 150 mm or about 250 mm wide was suitably applicable also to the laying of tiles in the field without leaving any odd portion at the time of arranging the tiles.

FIG. 2 is a plan view showing a mode of use of a conventional basalt tile, FIG. 3 is a plan view showing a mode of use of a special shape basalt tile having a length of 200 mm and a width of 150 mm, and FIG. 4 is a plan view showing a mode of use of a special shape basalt tile 200 mm long by 250 mm wide suitable for use in the present invention.

Basalt tiles employed usually are of a shape 200 mm by 200 mm and are laid in rows so that adjacent rows are displaced 50 mm from each other to construct a low $\mu$ road surface, as shown in FIG. 2. Also in case of a precast slab it is necessary to make such a displacement of rows, with consequent formation of such odd portion at every other row ends as in FIG. 2. However, in such arrangements as in FIGS. 3 and 4 there does not occur any odd portion. The basalt tiles shown in FIGS. 3 and 4 are applicable also to the laying in the field, but the effect thereof is remarkable in the form of a precast slab. By using the basalt tiles shown in FIGS. 3 and 4 in the form of precast slabs there are obtained low $\mu$ road surfaces having a uniform slip resistance and capable of being subjected to tests for which certain road surface properties are required, such as a split test and a slalom test.

Besides, since it is not necessary to cut basalt tiles and grind the cut portions, the cost for constructing a road surface can be reduced.

Further, also in fabricating a precast slab the tiles can be arranged in good order and therefore it is possible to shorten the manufacturing process.

The present invention is also based on the finding that, most preferably, in a precast slab with the above basalt tiles affixed to the surface thereof, a basalt tile is present also on a surface portion of the precast slab body where a hoisting, height-adjusting and back-filling hole is formed, the said tile being in communication with the said hole formed in the precast slab body. FIGS. 5 and 6 show examples of such holes formed in precast slabs. The holes shown in both figures are used for hoisting, height adjustment and grout. A suitable hole diameter is set according to the size of a precast slab used, etc., but is preferably in the range of 10 to 30 mm. FIG. 5 shows an example in which a hole is formed centrally of basalt tile, while FIG. 6 shows an example in which a hole is formed in a basalt tile end portion.

After installation of this precast slab, a manual work for the post-application of tile is not required and therefore not only the working efficiency is improved remarkably, but also a test course surface having a uniform accuracy can be constructed by laying the precast slab, without the occurrence of a difference in height or separation of the tiles from the precast slab caused by a poor bonding of the tiles.

Figure 1:
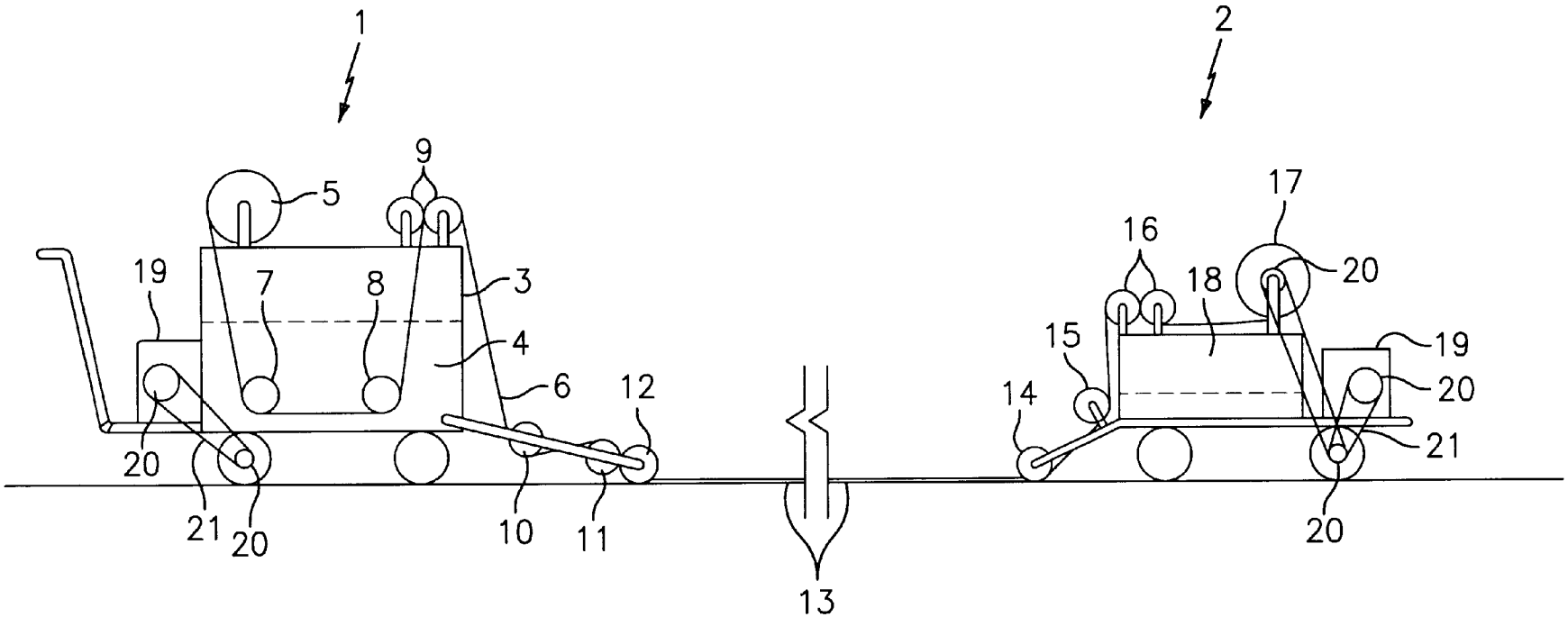
FIG. 1 is an explanatory diagram showing an example of equipment suitable for use in the acid treatment conducted in the present invention.
Figure 2:
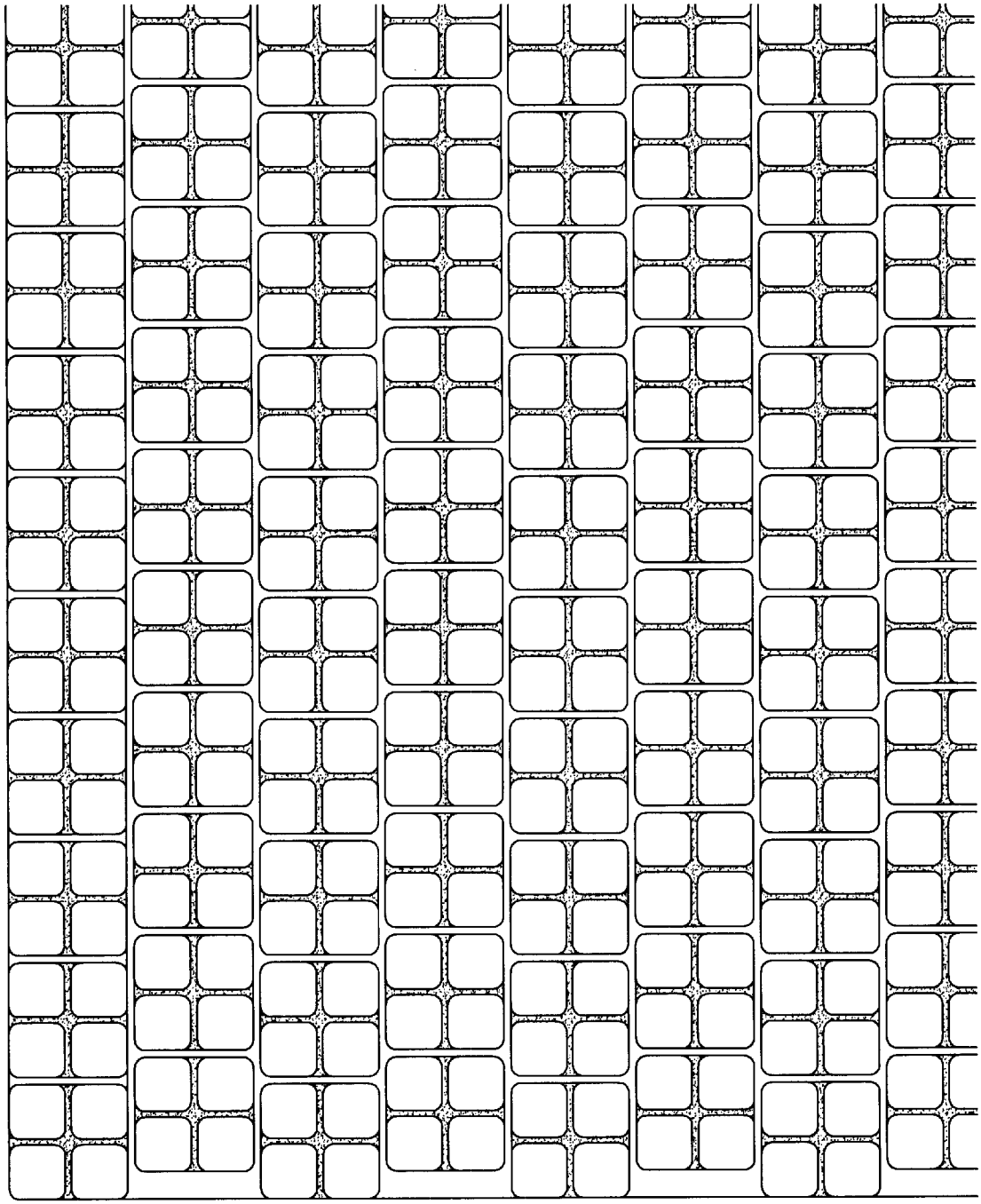
FIG. 2 is a plan view showing a mode of use of a conventional basalt tile.
Figure 3:
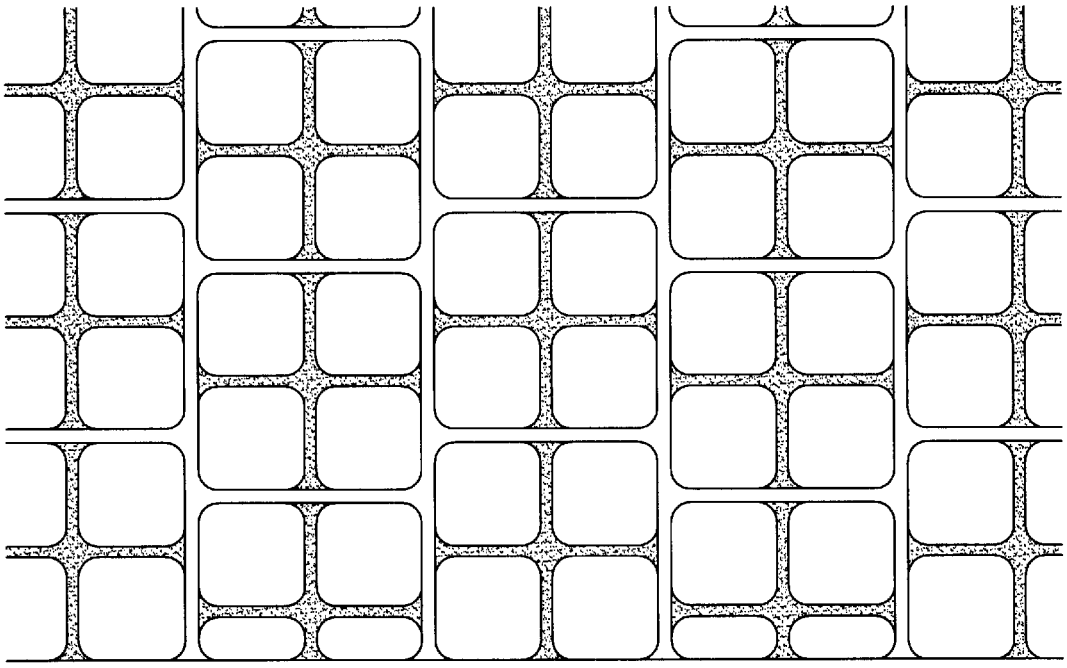
FIG. 3 is a plan view showing a mode of use of a special shape basalt tile which is 200 mm long by 150 mm wide.
Figure 4:
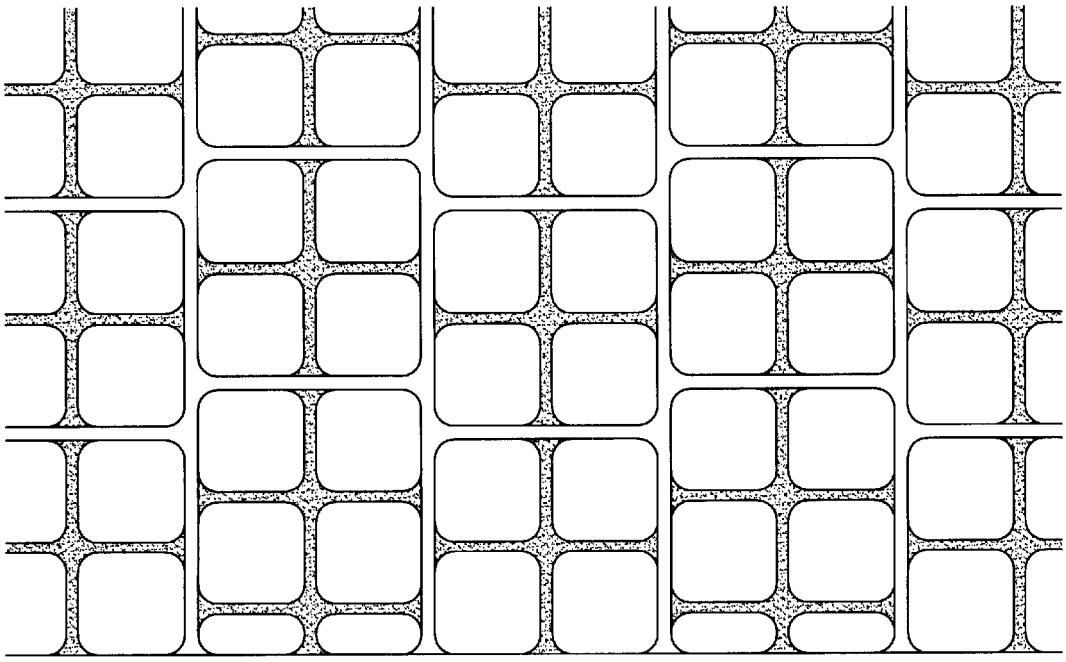
FIG. 4 is a plan view showing a mode of use of a special shape basalt tile which is 200 mm long by 250 mm wide.
Figure 5A:
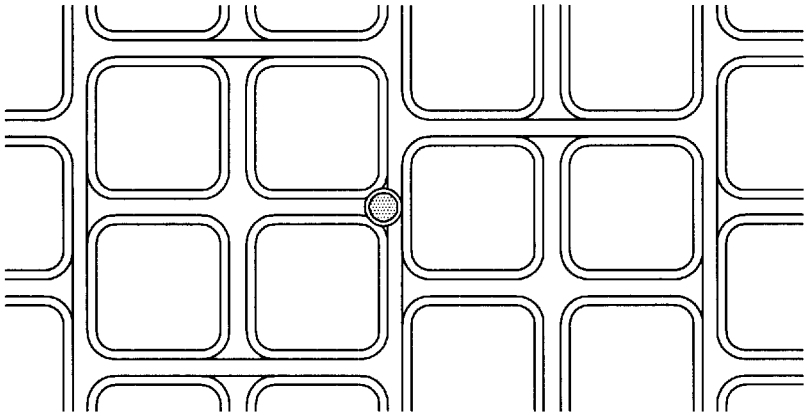
FIG. 5(A) is a front view showing a basalt tile with a hole formed centrally and FIG. 5(B) is a sectional view thereof.
Figure 5B:
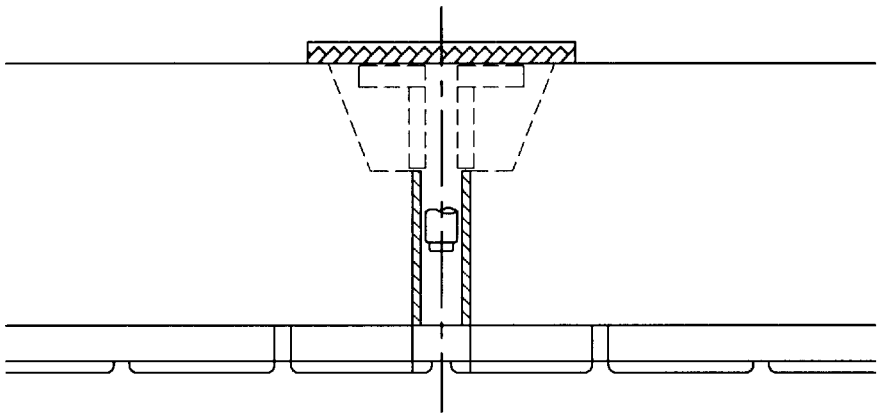
Figure 6:
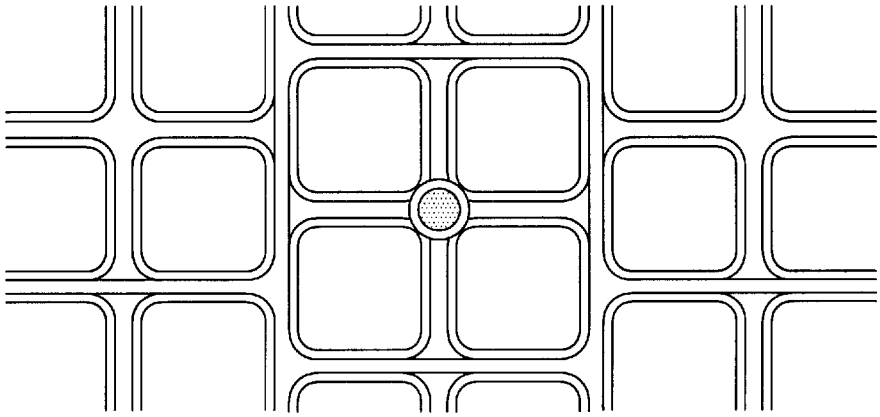
FIG. 6 is a front view showing a basalt tile with a hole formed in a tile end portion.

What is claimed is:

1. A method for recovering a slip resistance value of a basalt-tiled road surface, which comprises the steps of placing an elongated mat impregnated with an acid solution having a pH of 3.5 to 5.5 onto the road surface for a period of time sufficient to allow the basalt tile to react with the acid solution to roughen the road surface, and removing the mat.

2. The method of claim 1, comprising the additional step of roughening the road surface to form an automobile test course.

3. The method of claim 1, comprising the additional step of providing the mat with an air-tight film on one side thereof for suppressing evaporation on said side opposite to a side contacting the road surface.

4. The method of claim 2, comprising the additional step of roughening the road surface to form a low micron road surface for the automobile test course.

5. The method of claim 3, comprising the additional step of applying to the surface of the mat after the mat has been laid upon the road surface, said film which is selected from at least one of wax, silicone, polyvinyl chloride, polyurethane, acrylic resin, polyethylene, polyester and asphalt.

6. The method of claim 3, wherein the mat is formed from paper and said air-type film is polyvinyl chloride or polyethylene affixed or applied to one side of said paper mat.

7. The method of claim 1, comprising the additional step of providing work execution capacity of at least about 80 $m^2/h$.

8. The method of claim 1, comprising the additional step of suppressing evaporation of the applied acid solution while allowing the basalt tile to react with the acid solution to roughen the road surface.

9. The method of claim 1, comprising the additional steps of loading the elongated mat (6) in a rolled-up state onto a take-up roller (5) in a mat laying apparatus (1), drawing the elongated mat (6) out from the take-up roller (5) through a tank (3) containing the acid treating solution (4) underneath tension rollers (7,8), adjusting desired water retention by passing the mat (6) between squeeze rollers (9) after passing through said tank (3), drawing out the mat (6) to the pressing roller (12), moving the mat laying apparatus (1) forward to lay the mat (6) impregnated with the solution (4) upon the basalt-tiled road surface (13), after allowing the mat (6) to stand for the predetermined period of time, taking up the mat (6) in a rolled state by a separate mat winding apparatus (2) rearwardly of the mat laying apparatus (1) in a substantially opposite manner to unwinding of the mat (6) upon the road surface (13).

10. The method of claim 9, where the mat (6) is taken up by the additional steps of passing the mat (6) about a rearward pressing roller (14), and tension roller (15) and through squeeze rollers (16) situated above a recovery tank (18) for recovering the solution from the mat (6), and then rewinding the mat (6) about a rearward take-up roller (17).

* * * * *

UNITED STATES PATENT AND TRADEMARK OFFICE

CERTIFICATE OF CORRECTION

PATENT NO. : 6,528,111 B1 
DATED : March 4, 2003
INVENTOR(S) : Hajime Taniwaki, Osamu Saitoh and Yoshishige Takagi It is certified that error appears in the above-identified patent and that said Letters Patent is hereby corrected as shown below:

Title page,
Item [75], Inventors, "Osamu Taitoh" should be -- Osamu Saitoh --

Signed and Sealed this

Twenty-first Day of October, 2003

JAMES E. ROGAN
*Director of the United States Patent and Trademark Office*